United States Patent [19]

Cha

[11] Patent Number: 4,767,229

[45] Date of Patent: Aug. 30, 1988

[54] DRIP AND SPLATTER PROOF PAINT APPLICATOR

[76] Inventor: Edward Cha, 15 Marwood Rd. South, Port Washington, N.Y. 11050

[21] Appl. No.: 109,414

[22] Filed: Oct. 16, 1987

[51] Int. Cl.[4] ..... B05C 17/00; B05C 17/02

[52] U.S. Cl. ..... 401/208; 401/21; 401/22; 401/218

[58] Field of Search ..... 401/208, 218, 21, 22

[56] References Cited

U.S. PATENT DOCUMENTS

| | | | |
|---|---|---|---|
| 154,195 | 8/1874 | Smith | 401/208 |
| 206,909 | 8/1878 | Weber | 401/208 |
| 339,529 | 4/1886 | Cranston | 401/208 |
| 4,555,195 | 11/1985 | de Vreeze et al. | 401/218 |

FOREIGN PATENT DOCUMENTS

| | | | |
|---|---|---|---|
| 164764 | 1/1981 | Netherlands | 401/218 |
| 676595 | 7/1952 | United Kingdom | 401/218 |

*Primary Examiner*—Steven A. Bratlie
*Attorney, Agent, or Firm*—Michael I. Kroll

[57] ABSTRACT

A drip and splatter proof paint applicator is provided. The paint is placed and contained within a housing so as to be dispensed therefrom by an endless belt paint roller unit. The paint roller unit can be quickly disengaged therefrom so that the residue paint within the housing and on the paint roller unit can be cleaned after each use.

3 Claims, 1 Drawing Sheet

DRIP AND SPLATTER PROOF PAINT APPLICATOR

BACKGROUND OF THE INVENTION

1. Field of the Invention

The instant invention relates generally to painting tools and more specifically it relates to a drip and splatter proof paint applicator.

2. Description of the Prior Art

Numerous painting tools have been provided in prior art that are adapted to aid in applying paint to surfaces in need of paint, but can drip and splatter the paint when being used. While these units may be suitable for the particular purpose to which they address, they would not be as suitable for the purposes of the present invention as heretofore described.

SUMMARY OF THE INVENTION

A primary object of the present invention is to provide a drip and splatter proof paint applicator that will overcome the shortcomings of the prior art devices.

Another object is to provide a drip and splatter proof paint applicator in which the paint is placed and contained therein so as to be quickly dispensed therefrom without making a mess thus eliminating drop cloths.

An additional object is to provide a drip and splatter proof paint applicator in which the paint roller unit can be removed therefrom so that the paint within applicator can be cleaned out after each use of the applicator.

A further object is to provide a drip and splatter proof paint applicator that is simple and easy to use.

A still further object is to provide a drip and splatter proof paint applicator that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPITON OF THE DRAWING FIGURES

DETAILED DESCRIPTION OF THE PREFERRED EMBODIMENTS

Figure 1:
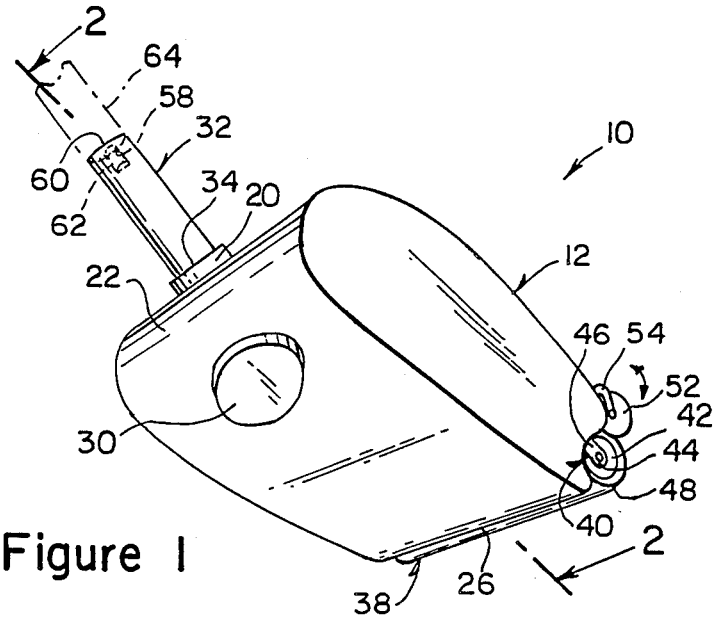
FIG. 1 is a perspective view of the invention.
Figure 3:
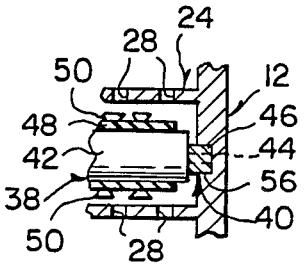
FIG. 3 is a cross sectional view taken along line 3—3 in FIG. 2 with parts broken away.
Figure 2:
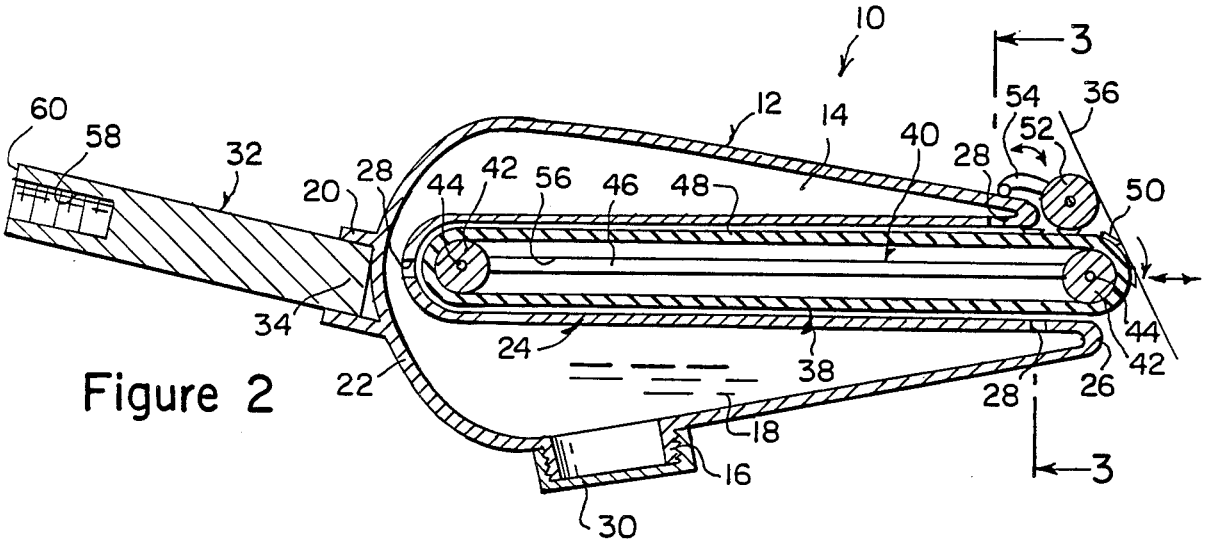
FIG. 2 is a cross sectional view taken along line 2—2 in FIG. 1, showing the internal structure in greater detail.
Figure 4:
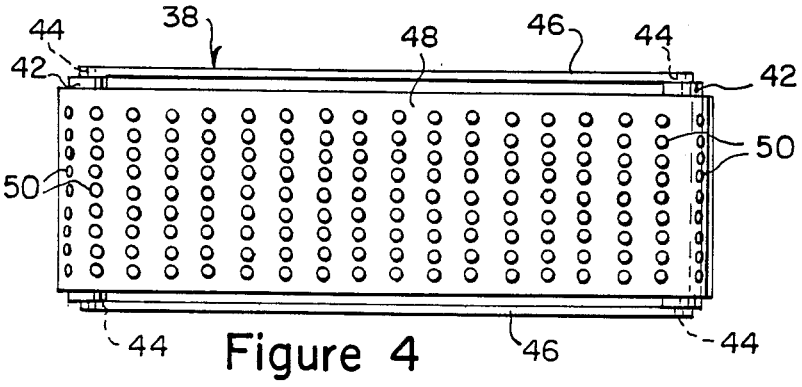
FIG. 4 is a top view of the removable paint roller unit showing the rows of tiny suction cups on the belt.
Figure 5:
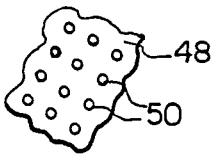
FIG. 5 is a partial top view of the belt of the removable paint roller unit showing the tiny suction cups in a diamond shaped pattern.

Turning now descriptively to the drawings, in which similar reference characters denote similar elements throughout the several views, FIGS. 1 through 5 illustrate a drip and splatter proof paint applicator 10 consisting of a housing 12 that has a hollow chamber 14, a filler neck 16 on one side for receiving paint 18 within the chamber 14, a collar 20 positioned at a slight angle at rear end 22 and a recessed portion 24 extending inwardly from front end 26 into the chamber 14. The recessed portion 24 has a plurality of holes 28 extending across its width in various locations for allowing the paint to exit from the chamber 14 when the housing 12 is placed in any position. A cap 30 attaches to the filler neck 16 of the housing 12 for sealing the paint within the chamber 14. A handle 32 is attached at one end 34 to the collar 20 of the housing 12 so that a person (not shown) can grip the handle 32 to manipulate the housing 12 with respect to a flat surface 36 to be painted.

A mechanism 38 is provided for applying the paint 18 from the chamber 14 of the housing 12 to the flat surface 36. The mechanism 38 is within the recessed portion 24 and sized to extend somewhat partly outwardly from the front end 26 of the housing 12 for applying the paint 18 therefrom.

A structure 40 is provided for removably attaching the paint applying mechanism 38 within the recessed portion 24 of the housing 12 allowing the paint applying mechanism 38 to be disengaged from the housing 12 so that the paint 18 within the housing 12 and on the paint applying mechanism 38 can be cleaned therefrom after each use of the applicator 10.

The paint applying mechanism 38 is a paint roller unit that includes a pair of spaced apart rollers 42 in which each of the rollers 42 has shaft ends 44 extending from opposite sides thereof. A pair of braces 46 are provided in which each of the braces 46 extends between one of the shaft ends 44 of each of the rollers 42 for holding the rollers apart and allowing the shaft ends 44 of the rollers to rotate thereabout. An endless belt 48 that has a plurality of suction cups 50 thereon extends around the rollers 42 so that the suction cups 50 can pick up the paint 18 and apply the paint onto the flat surface 36 when the housing is manually moved forward and backward. A guide roller 52 is spring biased, with a spring hinged arm 54, onto the housing 12 at the front end 26 thereof to ride on the suction cups 50 for smoothing out the paint 18 after the suction cups 50 apply the paint into the flat surface 36.

The removably attaching structure 40 includes the recessed portion 24 of the housing having a pair of parallel tracks 56, each formed in an opposite side wall 58 thereof and the pair of braces 46 sized to act as a pair of guide members to slideably fit into the tracks 56 so that the paint roller unit can be manually pulled out and pushed into the recessed portion 24 of the housing.

The handle 32 has a threaded aperture 58 at other end 60 opposite the collar 20 of the housing 12 so that threaded end 62 of an extension pole 64, shown in phantom in FIG. 1, can engage with the threaded aperture 58 allowing the applicator 10 to reach remote areas of the flat surface 36 to be painted.

It will be understood that each of the elements described above, or two or more together, may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A drip and splatter proof paint applicator which comprises:

(a) a housing having a hollow chamber, a filler neck on one side for receiving paint within the chamber, a collar positioned at a slight angle at rear end, and a recessed portion extending inwardly from front end into the chamber, the recessed portion having a plurality of holes extending across its width in various locations for allowing paint to exit from the chamber when said housing is placed in any position;

(b) a cap to attach to the filler neck of said housing for sealing the paint within the chamber;

(c) a handle attached at one end to the collar of said housing so that a person can grip said handle to manipulate said housing with respect to a flat surface to be painted;

(d) means for applying the paint from the chamber of said housing to the flat surface, said means being within the recessed portion and sized to extend somewhat partly outwardly from the front end of said housing for applying the paint therefrom, said paint applying means is a paint roller unit including a pair of spaced apart rollers each of which having shaft ends extending from opposite sides thereof, a pair of braces each of which extending between one of said shaft ends on said each of said pair of rollers for holding said pair of rollers apart and allowing said shaft ends of said pair of rollers to rotate thereabout, an endless belt extending around said pair of rollers and having a plurality of suction cups disposed thereon so that said suction cups pick up the paint and apply the paint directly to the flat surface when said housing is manually moved forward and backward without making a mess and thus eliminating the need for drop cloths, a guide roller spring biased onto said housing at the front end thereof to ride on said suction cups for smoothing out the paint after said suction cups apply the paint directly to the flat surface; and (e) means for removably attaching said paint applying means within the recessed portion of said housing allowing said paint applying means to be disengaged from said housing so that the paint within said housing and on said paint applying means can be cleaned therefrom after each use of said applicator.

2. A drip and splatter proof paint applicator as recited in claim 1, wherein said removably attaching means includes:

(a) the recessed portion of said housing having a pair of parallel tracks, each formed in an opposite side wall thereof; and (b) said pair of braces sized to act as a pair of guide members to slideably fit into the tracks so that said paint roller unit can be manually pulled out and pushed into the recessed portion of said housing.

3. A drip and splatter proof paint applicator as recited in claim 2, wherein said handle having a threaded aperture at other end opposite the collar of said housing so that threaded end of an extension pole can engage with the threaded aperture allowing said applicator to reach remote areas of the flat surface to be painted.

* * * * *